US008955937B2

(12) United States Patent
Metcalfe et al.

(10) Patent No.: US 8,955,937 B2
(45) Date of Patent: Feb. 17, 2015

(54) SYSTEM AND METHOD FOR INOPERABLE INKJET COMPENSATION

(75) Inventors: David Jon Metcalfe, Marion, NY (US); Joel Chan, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 85 days.

(21) Appl. No.: 13/555,892

(22) Filed: Jul. 23, 2012

(65) Prior Publication Data

US 2014/0022295 A1 Jan. 23, 2014

(51) Int. Cl.
*B41J 2/07* (2006.01)

(52) U.S. Cl.
USPC ..... 347/14; 347/9; 347/19

(58) Field of Classification Search
CPC ..... B41J 29/38
See application file for complete search history.

(56) References Cited

U.S. PATENT DOCUMENTS

| | | | | |
|---|---|---|---|---|
| 5,581,284 | A | 12/1996 | Hermanson | |
| 5,635,967 | A | 6/1997 | Klassen | |
| 6,215,557 | B1 | 4/2001 | Owens | |
| 6,575,549 | B1 | 6/2003 | Silverbrook | |
| 6,695,435 | B1 | 2/2004 | Cheng et al. | |
| 6,863,361 | B2 | 3/2005 | Barr et al. | |
| 6,880,907 | B2 | 4/2005 | Tsai | |
| 7,021,739 | B2 | 4/2006 | Burke et al. | |
| 7,075,677 | B1 | 7/2006 | Silverbrook | |
| 7,095,531 | B2 | 8/2006 | Mizes et al. | |
| 7,318,637 | B2 | 1/2008 | Ishimoto et al. | |
| 7,327,503 | B2 | 2/2008 | Yashima et al. | |
| 7,484,830 | B2 | 2/2009 | Kim et al. | |
| 7,639,402 | B2 | 12/2009 | Vestjens et al. | |
| 7,731,342 | B2 | 6/2010 | Mantell | |
| 7,815,274 | B2 | 10/2010 | De Waal | |
| 7,854,490 | B2 | 12/2010 | Snyder | |
| 7,866,778 | B2 | 1/2011 | Silverbrook et al. | |
| 7,866,779 | B2 * | 1/2011 | Martinez et al. | 347/13 |
| 7,887,154 | B2 * | 2/2011 | Vladislav | 347/19 |
| 7,903,290 | B2 | 3/2011 | Faken et al. | |
| 8,001,893 | B2 | 8/2011 | McCoy et al. | |
| 8,042,899 | B2 | 10/2011 | Folkins et al. | |
| 2004/0196320 | A1 | 10/2004 | Walmsley et al. | |
| 2005/0110817 | A1 | 5/2005 | Burke et al. | |
| 2005/0146543 | A1 | 7/2005 | Smith et al. | |
| 2005/0285897 | A1 | 12/2005 | Temple | |
| 2006/0125850 | A1 | 6/2006 | Kim et al. | |
| 2006/0279591 | A1 | 12/2006 | Lee | |
| 2006/0285131 | A1 | 12/2006 | Mantell et al. | |
| 2007/0153035 | A1 * | 7/2007 | Jung et al. | 347/9 |
| 2009/0315939 | A1 * | 12/2009 | Mantell et al. | 347/19 |
| 2010/0207983 | A1 * | 8/2010 | Sasayama | 347/14 |
| 2010/0245454 | A1 | 9/2010 | Ramakrishnan et al. | |
| 2011/0234673 | A1 * | 9/2011 | Ueshima | 347/14 |
| 2012/0075370 | A1 * | 3/2012 | Ramakrishnan et al. | 347/10 |
| 2012/0313989 | A1 * | 12/2012 | Mantell et al. | 347/12 |

* cited by examiner

*Primary Examiner* — Manish S Shah
*Assistant Examiner* — Jeremy DeLozier
(74) *Attorney, Agent, or Firm* — Maginot Moore & Beck LLP

(57) ABSTRACT

In an inkjet printer, a method for compensating for an inoperable inkjet includes identifying a density of image data in a region having a predetermined length in a process direction and at least one pixel corresponding to the inoperable inkjet. One other inkjet in the printer is operated to print ink drops onto an image receiving surface at a plurality of locations corresponding to the plurality of activated pixels for the inoperable inkjet in response to the identified density for the region exceeding a predetermined density threshold.

8 Claims, 10 Drawing Sheets

| | | | | |
|---|---|---|---|---|
| 0 | 1 | 0 | 0 | 0 |
| 0 | 0 | 0 | 1 | 0 |
| 1 | 1 | 1 | 0 | 0 |
| 1 | 0 | 1 | 1 | 1 |
| 1 | 1 | 0 | 0 | 1 |
| 0 | 1 | 1 | 1 | 1 |
| 1 | 0 | 1 | 0 | 0 |
| 0 | 0 | 0 | 1 | 1 |
| 1 | 0 | 0 | 1 | 0 |
| 0 | 1 | 1 | 1 | 0 |
| 0 | 1 | 0 | 0 | 0 |
| 1 | 1 | 1 | 0 | 1 |

SYSTEM AND METHOD FOR INOPERABLE INKJET COMPENSATION

TECHNICAL FIELD

This disclosure relates generally to inkjet printers that eject ink onto an image receiving surface and, more particularly, to inkjet printers that alter the operation of inkjets to compensate for inkjets that are unable to eject ink onto the image receiving surface at a predetermined position.

BACKGROUND

Drop on demand inkjet technology for producing printed media has been employed in commercial products such as printers, plotters, and facsimile machines. Generally, an inkjet image is formed by selectively ejecting ink drops from a plurality of inkjets, which are arranged in one or more printheads, onto an image receiving surface. In an indirect inkjet printer, the printheads eject ink drops onto the surface of an intermediate image receiving member such as a rotating imaging drum or belt. During printing, the printheads and the image receiving surface move relative to one other and the inkjets eject ink drops at appropriate times to form an ink image on the image receiving surface. A controller in the printer generates electrical signals, also known as firing signals, at predetermined times to activate individual inkjets in the printer. The ink ejected from the inkjets can be liquid ink, such as aqueous, solvent, oil based, UV curable ink or the like, which is stored in containers installed in the printer. Alternatively, some inkjet printers use phase change inks that are loaded in a solid form and delivered to a melting device. The melting device heats and melts the phase change ink from the solid phase to a liquid that is supplied to a printhead for printing as liquid drops onto the image receiving surface.

During the operational life of these printers, inkjets in one or more printheads may become unable to eject ink in response to a firing signal. The defective condition of the inkjet may be temporary and the inkjet may return to operational status after one or more image printing cycles. In other cases, the inkjet may not be able to eject ink until a purge cycle is performed. A purge cycle can unclog inkjets and return inoperable inkjets to operation. Execution of a purge cycle, however, requires the printer to be taken out of its image generating mode. Thus, purge cycles affect the throughput rate of a printer and are typically performed during periods in which the printer is not generating images.

One method to correct image defects produced by an inoperable inkjet includes repositioning the printhead to move another inkjet into a location normally occupied by the inoperable inkjet. The controller operates the other inkjet to substitute for the defective inkjet. The substitution process can completely eliminate image defects due to the inoperable inkjet, but the image receiving member has to rotate past the printhead one or more additional times for the substitute inkjet to print ink drops to correct for the inoperable inkjet. The additional rotations, which also referred to as additional "passes" during printing, reduce the effective throughput of the printer.

Another correction method compensates for an inoperable inkjet by printing additional ink drops from several inkjets that are near the inoperable inkjet in the printhead. The ink drops from the nearby inkjets can camouflage defects that are produced by the inoperable inkjet. The compensating inkjets can operate during normal printing operations so the compensation process does not reduce the throughput of the printer. One drawback of the compensation process is that the ink drops from the neighboring inkjets do not completely correct errors due to the inoperable inkjet. Some printed images can still include noticeable defects even when the printer compensates for the inoperable inkjet.

As described above, existing correction techniques can reduce or eliminate the impact of an inoperable inkjet on printed image quality, but the existing techniques also have drawbacks due to reduced printer throughput or inadequate correction of image defects. Consequently, improvements to the operation of inkjet printers that compensate for inoperable inkjets with a reduced impact to the printer throughput rate, while producing printed images with fewer perceived defects would be beneficial.

SUMMARY

In one embodiment, a method of compensating for a defective inkjet in a printer has been developed. The method includes identifying a plurality of activated pixels in image data corresponding to the inoperable inkjet in a first printhead in the printer, identifying a density of activated pixels in a first region of the image data including at least one of the plurality of activated pixels corresponding to the inoperable inkjet, the first region of the image data including a first predetermined number of pixels in a process direction, and operating one other inkjet to eject ink drops onto an image receiving surface at a plurality of locations corresponding to the plurality of activated pixels for the inoperable inkjet in response to the identified density for the first region exceeding a first predetermined density threshold.

In another embodiment, an inkjet printer that compensates for a defective inkjet has been developed. The inkjet printer includes a first printhead including a plurality of inkjets, an image receiving surface configured to move past the first printhead in a process direction to receive ink ejected from the plurality of inkjets, a memory configured to store image data, and a controller operatively connected to the memory and the first printhead. The controller is configured to identify a plurality of activated pixels in the image data corresponding to the inoperable inkjet, identify a density of activated pixels in a first region of the image data including at least one of the plurality of activated pixels corresponding to the inoperable inkjet, the first region of the image data including a first predetermined number of pixels in a process direction, and operate one other inkjet to eject ink drops onto the image receiving surface at a plurality of locations corresponding to the plurality of activated pixels for the inoperable inkjet in response to the identified density for the first region exceeding a first predetermined density threshold.

In another embodiment, a method of compensating for a defective inkjet in a printer has been developed. The method includes identifying a plurality of activated pixels in image data corresponding to the inoperable inkjet in a printhead in the printer, identifying a density of activated pixels in a region of the image data including at least one of the plurality of activated pixels corresponding to the inoperable inkjet, the region of the image data including a predetermined number of pixels in a process direction, modifying the image data to include an additional plurality of activated pixels proximate to the plurality of activated pixels corresponding to the inoperable inkjet in response to the identified density being below a predetermined density threshold, the additional plurality of activated pixels corresponding to a plurality of inkjets that are proximate to the inoperable inkjet in the cross-process direction, and operating the plurality of inkjets to eject ink drops with reference to the additional plurality of activated pixels in the image data in response to the identified density being below the predetermined density threshold.

BRIEF DESCRIPTION OF THE DRAWINGS

The foregoing aspects and other features of a printer that enable compensation for defective inkjets are explained in the following description, taken in connection with the accompanying drawings.

DETAILED DESCRIPTION

Figure 1:
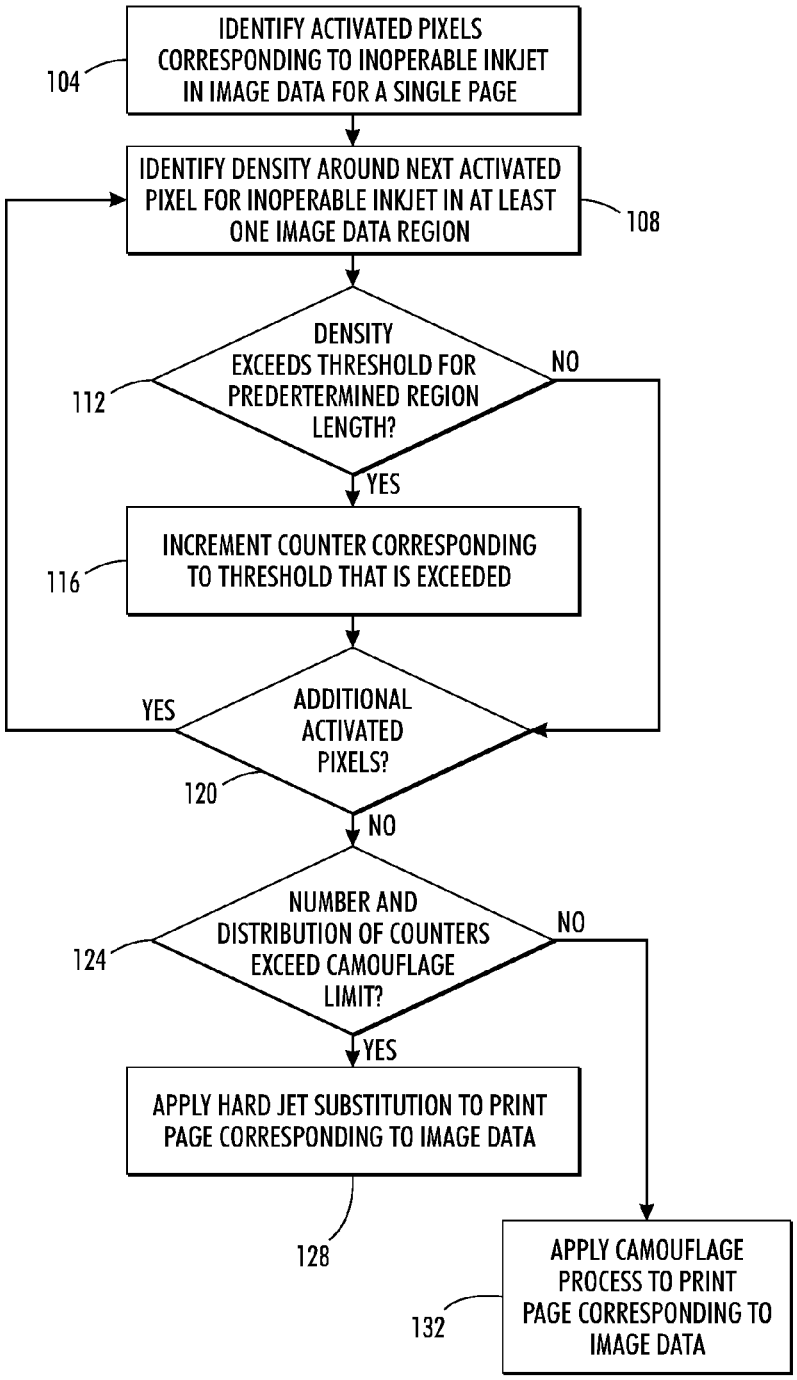
FIG. 1 is a block diagram of a process for selecting a hard jet substitution or inkjet camouflage process to compensate for an inoperable inkjet during printing of an image on a print medium.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces images with colorants on media, such as digital copiers, bookmaking machines, facsimile machines, multi-function machines, or the like.

As used herein, the term "inoperable inkjet" refers to a malfunctioning inkjet in a printer that does not eject ink drops, ejects ink drops only on an intermittent basis, or ejects ink drops onto an incorrect location of an image receiving member when the inkjet receives an electrical firing signal. A typical inkjet printer includes a plurality of inkjets in one or more printheads, and operational inkjets can compensate for the inoperable inkjet to preserve the quality of printed images when an inkjet becomes inoperable.

As used herein, the term "process direction" refers to a direction of movement of an image receiving surface, such as an imaging drum or paper sheet, through a printer during an imaging operation. The image receiving surface moves past one or more printheads in a print zone in the process direction, and the printheads eject ink drops to form two dimensional images on the image receiving surface. An inoperable inkjet does not eject the ink drops, which can produce a perceptible line or "streak" through the printed image corresponding to the inoperable inkjet. As used herein, the term "cross-process direction" refers to a direction on the surface of the image receiving member that is perpendicular to the process direction. The inkjets in a printhead and multiple printheads in a print zone are arranged in the cross-process direction to form printed images on the image receiving surface. The printer ejects ink drops with reference to image data that are depicted in a two-dimensional array corresponding to the process direction and cross-process direction.

As used herein, the term "pixel" refers to a single value in a two-dimensional arrangement of image data corresponding to an ink image that an inkjet printer forms on an image receiving surface. The locations of pixels in the image data correspond to locations of ink drops on the image receiving surface that form the ink image when multiple inkjets in the printer eject ink drops with reference to the image data. An "activated pixel" refers to a pixel in the image data wherein the printer ejects a drop of ink onto an image receiving surface location corresponding to the activated pixel. A "deactivated pixel" refers to a pixel in the image data having a value where the printer does not eject a drop of ink onto an image receiving surface location corresponding to the deactivated pixel. The term "binary image data" refers to image data formed as a two-dimensional arrangement of activated and deactivated pixels. Each pixel in the binary image data has one of two values indicating that the pixel is either activated or deactivated. An inkjet printer forms ink images by selectively ejecting ink drops corresponding to the activated pixels in the image data. A multicolor printer ejects ink drops of different ink color with reference to separate sets of binary image data for each of the different colors to form multicolor ink images.

As used herein, the terms "image density" and "pixel density" are used interchangeably and refer to the proportion of activated pixels within a given region of image data. The image density can be expressed as a percentage value. For example, if an arrangement of one hundred pixels includes thirty five activated pixels and sixty five deactivated pixels, then the overall image density of the arrangement is thirty five percent. As described in more detail below, the image density in a region including activated pixels corresponding to an inoperable inkjet can be identified using weighted values to assign a greater density value to activated pixels that are proximate to the location of the inoperable inkjet, and discount the value of pixels that are farther from the inoperable inkjet in the image data.

As used herein, the term "hard inkjet substitution" (HJS) refers to a process that compensates for an inoperable inkjet in a printer by operating one other inkjet to eject in drops onto a location of the image receiving surface that corresponds to the inoperable inkjet. For example, an actuator moves a printhead including the inoperable inkjet and at least one operational inkjet in the cross-process direction to align the operational inkjet with the image receiving surface in the cross-process direction corresponding to the position where the inoperable inkjet would have ejected an ink drop prior to the movement of the printhead. The printer then ejects ink drops using the operational inkjet to compensate for the inoperable inkjet. In another embodiment, a printer that includes multiple printheads arranged in the process direction operates an operational inkjet in another printhead to eject ink drops onto the image receiving surface in the same location as the inoperable inkjet, or in close proximity to the inoperable inkjet.

As used herein, the terms "soft inkjet substitution" or "missing inkjet camouflaging" (MJC) are used interchangeably and refer to a process that compensates for an inoperable inkjet using one or more neighboring inkjets in the printhead with the inoperable inkjet or in another printhead in the printer. This process is performed without movement of any printhead. The missing inkjet camouflaging process selects one or more inkjets that are proximate to the inoperable inkjet in the cross-process direction to print ink drops on the image receiving surface proximate to the locations of ink drops from the inoperable inkjet that are included in the image data.

Figure 6:
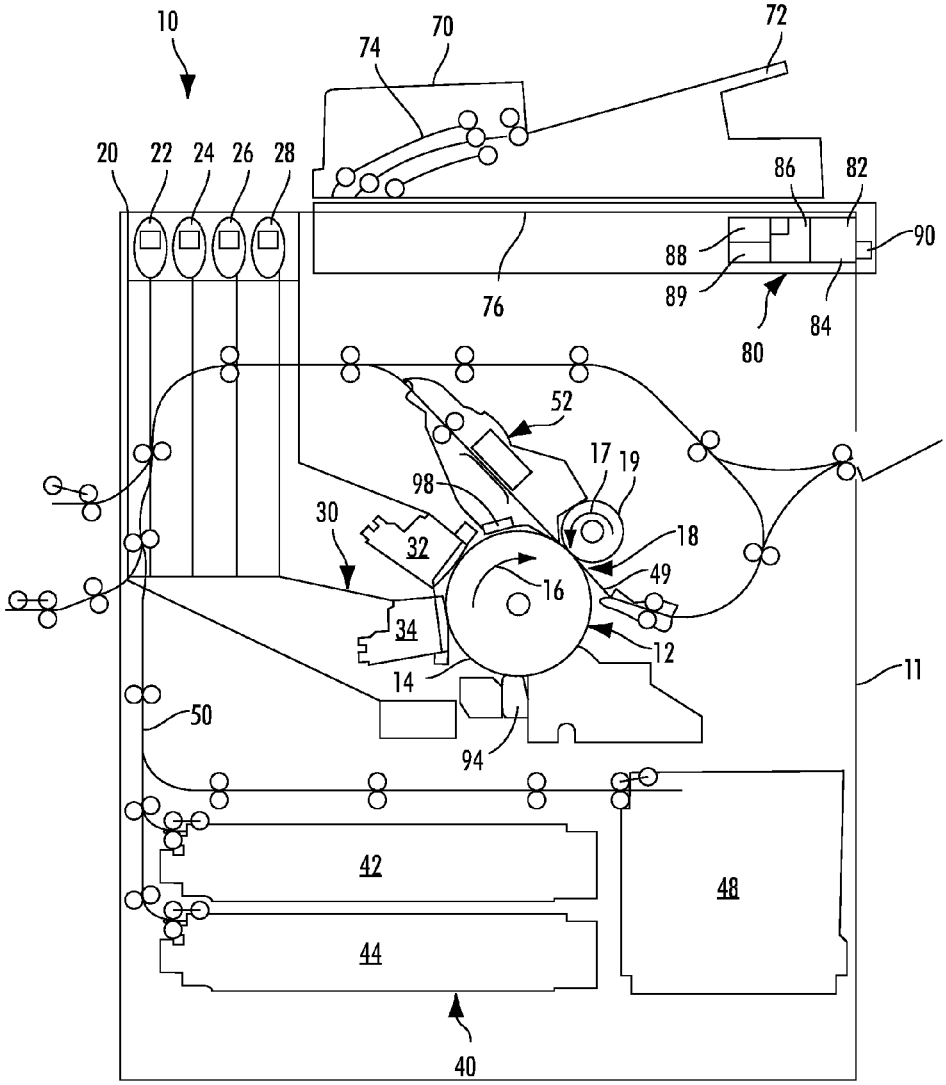
FIG. 6 PRIOR ART
FIG. 6 is a schematic diagram of a prior art printer 10 that can be configured to compensate for one or more inoperable inkjets.

FIG. 6 depicts an embodiment of a prior art printer 10 that can be configured to compensate for one or more inoperable inkjets. As illustrated, the printer 10 includes a frame 11 to which is mounted directly or indirectly all its operating subsystems and components, as described below. The phase change ink printer 10 includes an image receiving member 12 that is shown in the form of a rotatable imaging drum, but can equally be in the form of a supported endless belt. The image receiving member 12 includes an image receiving surface 14, which provides a surface for formation of ink images. An actuator 94, such as a servo or electric motor, engages the image receiving member 12 and is configured to rotate the image receiving member in direction 16. A transfix roller 19 rotatable in the direction 17 loads against the image receiving surface 14 of the image receiving member 12 to form a transfix nip 18 within which ink images formed on the surface 14 are transfixed onto a heated print medium 49.

The phase change ink printer 10 also includes a phase change ink delivery subsystem 20 that has multiple sources of different color phase change inks in solid form. Since the phase change ink printer 10 is a multicolor printer, the ink delivery subsystem 20 includes four (4) sources 22, 24, 26, 28, representing four (4) different colors CMYK (cyan, magenta, yellow, and black) of phase change inks. The phase change ink delivery subsystem also includes a melting and control apparatus (not shown) for melting or phase changing the solid form of the phase change ink into a liquid form. Each of the ink sources 22, 24, 26, and 28 includes a reservoir used to supply the melted ink to the printhead assemblies 32 and 34. In the example of FIG. 6, both of the printhead assemblies 32 and 34 receive the melted CMYK ink from the ink sources 22-28. In another embodiment, the printhead assemblies 32 and 34 are each configured to print a subset of the CMYK ink colors.

The phase change ink printer 10 includes a substrate supply and handling subsystem 40. The substrate supply and handling subsystem 40, for example, includes sheet or substrate supply sources 42, 44, 48, of which supply source 48, for example, is a high capacity paper supply or feeder for storing and supplying image receiving substrates in the form of a cut sheet print medium 49. The phase change ink printer 10 as shown also includes an original document feeder 70 that has a document holding tray 72, document sheet feeding and retrieval devices 74, and a document exposure and scanning subsystem 76. A media transport path 50 extracts print media, such as individually cut media sheets, from the substrate supply and handling system 40 and moves the print media in a process direction P. The media transport path 50 passes the print medium 49 through a substrate heater or pre-heater assembly 52, which heats the print medium 49 prior to transfixing an ink image to the print medium 49 in the transfix nip 18.

Media sources 42, 44, 48 provide image receiving substrates that pass through media transport path 50 to arrive at transfix nip 18 formed between the image receiving member 12 and transfix roller 19 in timed registration with the ink image formed on the image receiving surface 14. As the ink image and media travel through the nip, the ink image is transferred from the surface 14 and fixedly fused to the print medium 49 within the transfix nip 18. In a configuration that produces duplex prints, the media transport path 50 passes the print medium 49 through the transfix nip 18 a second time for transfixing of a second ink image to a second side of the print medium 49.

Operation and control of the various subsystems, components and functions of the printer 10 are performed with the aid of a controller or electronic subsystem (ESS) 80. The ESS or controller 80, for example, is a self-contained, dedicated mini-computer having a central processor unit (CPU) 82 with a digital memory 84, and a display or user interface (UI) 86. The ESS or controller 80, for example, includes a sensor input and control circuit 88 as well as an ink drop placement and control circuit 89. In one embodiment, the ink drop placement control circuit 89 is implemented as a field programmable gate array (FPGA). In addition, the CPU 82 reads, captures, prepares and manages the image data flow associated with print jobs received from image input sources, such as the scanning system 76, or an online or a work station connection 90. As such, the ESS or controller 80 is the main multi-tasking processor for operating and controlling all of the other printer subsystems and functions.

The controller 80 can be implemented with general or specialized programmable processors that execute programmed instructions, for example, printhead operation. The instructions and data required to perform the programmed functions are stored in the memory 84 that is associated with the processors or controllers. The processors, their memories, and interface circuitry configure the printer 10 to form ink images, and, more particularly, to control the operation of inkjets in the printhead modules 32 and 34 to compensate for inoperable inkjets. These components are provided on a printed circuit card or provided as a circuit in an application specific integrated circuit (ASIC). Each of the circuits can be implemented with a separate processor or multiple circuits are implemented on the same processor. In alternative configurations, the circuits are implemented with discrete components or circuits provided in very large scale integration (VLSI) circuits. Also, the circuits described herein can be implemented with a combination of processors, FPGAs, ASICs, or discrete components.

In operation, the printer 10 ejects a plurality of ink drops from inkjets in the printhead assemblies 32 and 34 onto the surface 14 of the image receiving member 12. The controller 80 generates electrical firing signals to operate individual inkjets in one or both of the printhead assemblies 32 and 34. In the multi-color printer 10, the controller 80 processes digital image data corresponding to one or more printed pages in a print job, and the controller 80 generates two dimensional bit maps for each color of ink in the image, such as the CMYK colors. Each bit map includes a two dimensional arrangement of pixels corresponding to locations on the image receiving member 12. Each pixel has one of two values indicating if the pixel is either activated or deactivated. The controller 80 generates a firing signal to activate an inkjet and eject a drop of ink onto the image receiving member 12 for the activated pixels, but does not generate a firing signal for the deactivated pixels. The combined bit maps for each of the colors of ink in the printer 10 generate multicolor or monochrome images that are subsequently transfixed to the print medium 49. The controller 80 generates the bit maps with selected activated pixel locations to enable the printer 10 to produce multi-color images, half-toned images, dithered images, and the like.

During a printing operation, one or more of the inkjets in the printhead assemblies 32 and 34 may become inoperable. An inoperable inkjet may eject ink drops on an intermittent basis, eject ink drops onto an incorrect location on the image receiving surface 14, or entirely fail to eject ink drops. In the printer 10, an optical sensor 98 generates image data corresponding to the ink drops that are printed on the image receiving surface 14 after formation of the ink images and prior to the image receiving member 12 rotating through the nip 18 to transfix the ink images. In one embodiment, the optical sensor 98 includes a linear array of individual optical detectors that detect light reflected from the image receiving surface. The individual optical detectors each detect an area of the image receiving member corresponding to one pixel on the surface of the image receiving member in a cross-process direction, which is perpendicular to the process direction P. The optical sensor 98 generates digital data, referred to as reflectance data, corresponding to the light reflected from the image receiving surface.

The controller 80 is configured to identify inoperable inkjets in the printhead assemblies 32 and 34 with reference to the reflectance values detected on the imaging receiving surface 14 and the predetermined image data of the printed ink images. In an alternative embodiment, an optical sensor detects defects in ink images after the ink images have been formed on the print medium 49. In another alternative embodiment, the inoperable inkjets are identified with sensors located in the printhead assemblies. In response to identifying an inoperable inkjet, the controller 80 ceases generation of firing signals for the inoperable inkjet.

The printer 10 is an illustrative embodiment of a printer that compensates for inoperable inkjets using the processes described herein, but the processes described herein can compensate for inoperable inkjets in alternative inkjet printer configurations. For example, while the printer 10 depicted in FIG. 6 is configured to eject drops of a phase change ink, alternative printer configurations that form ink images using different ink types including aqueous ink, solvent based ink, UV curable ink, and the like can be operated using the processes described herein. Additionally, while printer 10 is an indirect printer, printers that eject ink drops directly onto a print medium can be operated using the processes described herein.

FIG. 1 depicts a process 100 for forming an ink image for a printed page using either a hard or soft inkjet substitution operation to compensate for one or more inoperable inkjets in an inkjet printer. In the discussion below, a reference to the process performing a function or action refers to a controller executing programmed instructions stored in a memory operatively connected to the controller to operate one or more components of the printer to perform the function or action. FIG. 1 is described with reference to the printer 10 of FIG. 6 for illustrative purposes.

Process 100 begins by identifying activated pixels that correspond to an inoperable inkjet in image data corresponding to a printed page (block 104). In the printer 10, the controller 80 identifies the column of image data associated with the inoperable inkjet and the activated pixels in the column of image data.

Figure 5A:
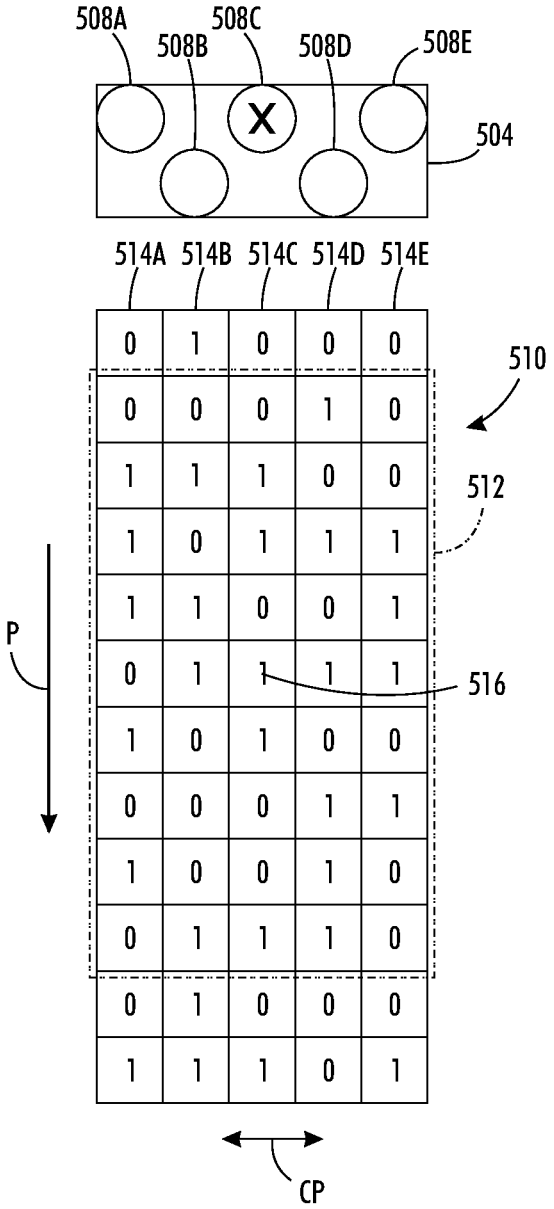
FIG. 5A is a schematic diagram of a printhead with an inoperable inkjet and image data corresponding to inkjets in the printhead.

FIG. 5A depicts a printhead 504 with operational inkjets 508A, 508B, 508D, and 508E, and with an inoperable inkjet 508C. FIG. 5A also depicts binary image data 510 including activated pixels (labeled with a "1") and deactivated pixels (labeled with "0"). In FIG. 5A, a column 514C of the image data 510 is arranged in the process direction P. The activated pixels in column 514C, such as pixel 516, are depicted with a "1" value and the deactivated pixels are depicted with a "0" value. As described below, the process 100 compensates for the activated pixels in the pixel column 514C using either HJC or MJC.

Referring again to FIG. 1, process 100 identifies both a density of one or more regions of the image data around the activated pixels that correspond to the inoperable inkjet in the image data (block 108). For example, in FIG. 5A a region of pixels 512 around activated pixel 516 extends in both the process direction P and cross-process direction CP. The selected region 512 has a predetermined process direction length of nine pixels in the example of FIG. 5A, but regions with different numbers of pixels in the process direction can be selected as well. The controller 80 identifies a pixel density of the region 512 with reference to the number of activated pixels in the region 512, the total number of pixels in the region 512, and optionally with reference to the relative location of activated pixels with reference to the pixel 516. In one configuration, the controller 80 assigns relative weights to the values with reference to the cross-process direction distance from the pixel columns 514A-514E to the activated pixel 516. The pixels in the column 514C corresponding to the inoperable inkjet 508C receive the greatest weight value, the pixels in columns 514B and 514D receive an intermediate weight value, and the pixels in columns 514A and 514D receive a smaller weight value.

In another embodiment of process 100, the pixels in the region are weighted with reference to the process direction distance from the activated pixel 516. In still another embodiment, each pixel receives an equal weight during the identification of the pixel density for the region. In some embodiments, process 100 identifies the pixel density of multiple regions with different sizes in the process direction and cross-process direction around the activated pixels corresponding to the inoperable inkjet. The identified density values for different region lengths in the process direction correspond to multiple density thresholds with various levels of perceptibility for errors in a printed image that is produced with the inoperable inkjet.

If the density exceeds the predetermined threshold for the corresponding process direction length of the region surrounding an activated pixel (block 112), then process 100 increments a counter corresponding to the region length and density threshold that is exceeded (block 116). Process 100 continues to identify the next activated pixel in the image data that corresponds to the inoperable inkjet (block 120). As described in more detail below, process 100 can include multiple counters with varying density thresholds for regions with different process direction lengths to identify the impact of the inoperable inkjet in different regions of image data.

Figure 2:
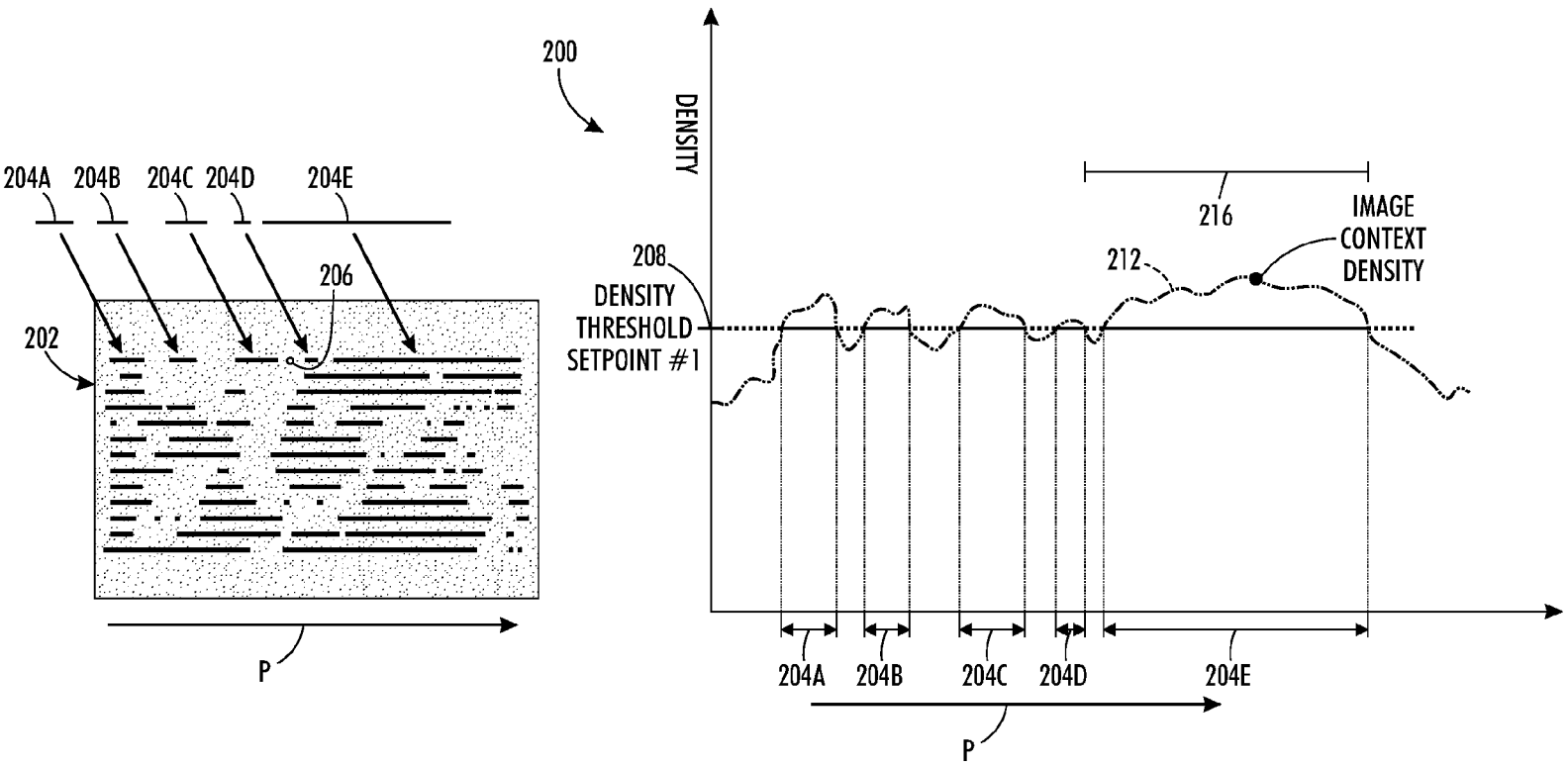
FIG. 2 is a diagram of image data and variations in the density of the image data with reference to a first density threshold.
Figure 3:
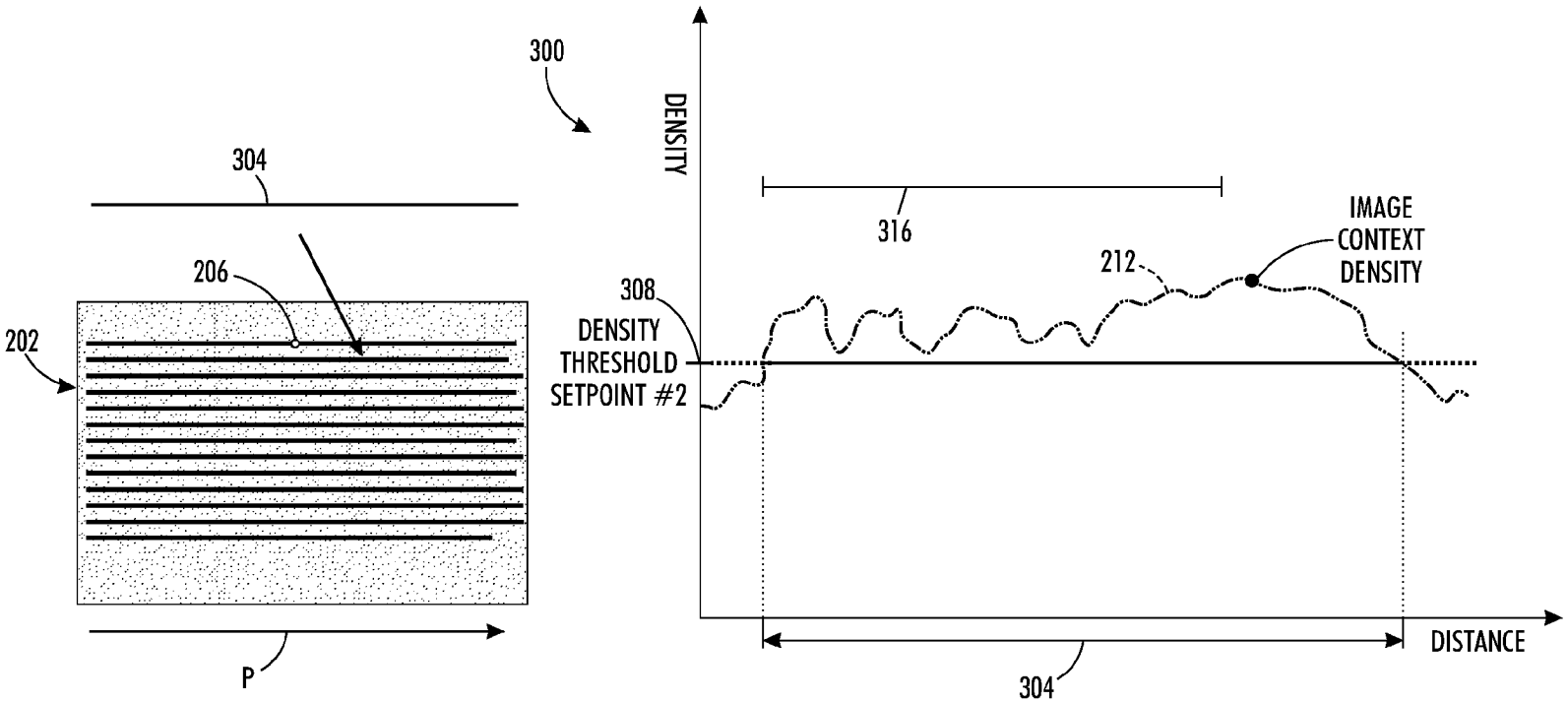
FIG. 3 is a diagram of the image data and variations in the density of the image data of FIG. 2 with reference to a second density threshold.

FIG. 2 and FIG. 3 depict image data and graphs of the density of image data in a region around activated pixels that correspond to an inoperable inkjet. Referring to FIG. 2, image data 202 include series of pixels that correspond to an inoperable inkjet, including an exemplary activated pixel 206. The graph 200 depicts density values 212 for a region of image data around the inoperable inkjet along the process direction P. In the graph 200, a predetermined image density threshold 208 and process direction length 216 are used to identify if the image density and length around the activated pixel 206 exceeds a predetermined threshold. In FIG. 2, the image data density values 212 exceed the density threshold 208 in a plurality of process direction segments 204A-204E. The variations in the image data density are due to variations in the half-tone pattern of the image data 202. In the example of the graph 200, the density of the image data exceed the threshold 208, but none of the segments 204A-204E have a length in the process direction P that is equal to or greater than the process direction length of the image data region 216. For example, the longest contiguous segment 204E is shorter than the process direction length 216 in the process direction P. Consequently, the image data in FIG. 2 in the region around the activated pixel 206 do not exceed the combined density threshold 208 and process direction length threshold 216.

FIG. 3 depicts the image data 202 and activated pixel 206 of FIG. 2 with a graph 300 including another density threshold 308 and process direction region length 316. In FIG. 3, the density threshold 308 is lower than the density threshold 208, and the process direction region length 316 is longer than the process direction length threshold 216 of FIG. 2. In FIG. 3, the image density values 212 exceed the image density threshold 308 in a contiguous process direction segment 304. In the example of FIG. 3, the process direction segment 304 exceeds the length of the process direction length of the region 316. Thus, the image data 202 exceed both the density threshold 308 for the region 316 in FIG. 3, and the controller 80 increments a counter that is associated with the threshold during process 100.

Figure 4:
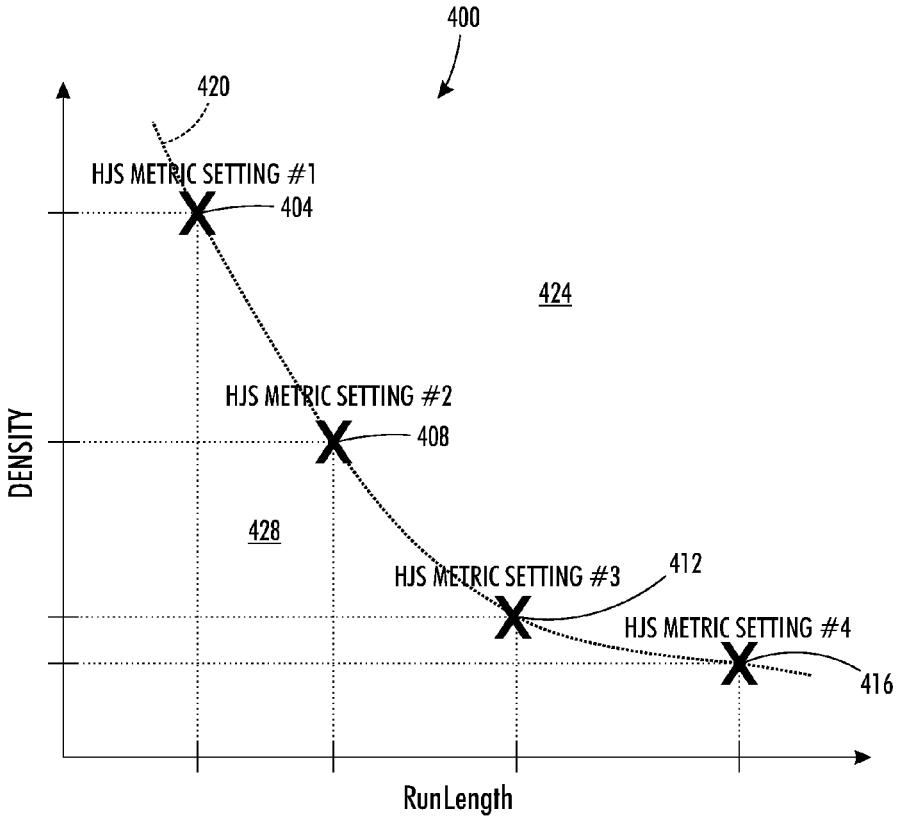
FIG. 4 is a graph that depicts a plurality of thresholds for identifying different process direction lengths and density values of image data.

As depicted in FIG. 2 and FIG. 3, the process 100 can include multiple image density thresholds for regions having different process direction lengths. FIG. 4 depicts graph 400 including a plurality of thresholds 404, 408, 412, and 416 that correspond to different combinations of process direction length, in pixels, for different image regions and densities. For example, threshold 404 has a higher density, but a shorter process direction region length than the other thresholds 408-416. Thus, the threshold 404 is exceeded in regions of the image data with high density with either shorter or longer process direction lengths. The threshold 416 has a lower density value, but a longer process direction length than the other thresholds 404-412. Thus, threshold 416 is exceeded in lower density image data regions around an inoperable inkjet that extend for longer lengths in the process direction. The thresholds 408 and 412 have intermediate density and process direction length values. In the example of FIG. 4, the multiple thresholds 404-416 approximate a threshold curve 420. If the density for a region of image data with a given process direction length identified for activated pixels of the inoperable inkjet are in a region 424 above the curve 420, then process 100 increments a counter to indicate that the threshold has been exceeded. If, however, the density and process direction length identified for the activated pixels are below the threshold curve 420 in region 428, then process 100 does not increment the corresponding threshold counter. In alternative configurations, process 100 identifies the image density and process direction length around each activated pixel for the inoperable inkjet with reference to a single threshold, or with reference to a different number and arrangement of thresholds than are depicted in FIG. 4.

Referring again to FIG. 1, if the image densities for any of the regions do not exceed one or more of the predetermined thresholds, then none of the threshold counters are incremented (block 112), and process 100 continues to process the next activated pixel corresponding to the inoperable inkjet (block 120). The processing described above with reference to blocks 108-120 continues for each of the activated pixels in the image data that correspond to the inoperable inkjet.

After identification of the number of times that the image data density exceeds the predetermined thresholds in one or more regions of image data for the inoperable inkjet, process 100 selects either an HJS or MJC operation to apply during a printing operation. As described above, the HJS operation can correct for high perceptibility errors, while the MJC operation can compensate for lower perceptibility errors with higher printer throughput than the HJS method. If the number and distribution of counters for each of the identified thresholds exceeds a predetermined MJC limit (block 124), then the printer 10 applies an HJS operation to form a printed page corresponding to the image data (block 128). If, however, the counters do not exceed the MJC limit (block 124), then the printer 10 applies an MJC operation to form the printed page corresponding to the image data (block 132).

In one embodiment, process 100 selects the HJS operation if the counter values for any of the thresholds, such as the thresholds 404-416 in FIG. 4, are exceeded (e.g. if any counter value is greater than or equal to one). In another embodiment, the selection of HJS or MJC is made with reference to the distribution of counters for each threshold. For example, in some print modes, if even a short process direction length of a high density image region includes an inoperable inkjet, then the printer applies HJS. For example, in FIG. 4 if the counter associated with threshold 404 has a value greater than zero, then the printer 10 applies the HJS operation. Conversely, if one of the lower density thresholds with a longer process direction length is exceeded a small number of times, the printer 10 can select the MJC operation. For example, if the threshold 416 in FIG. 6 is exceeded one time in the image data, but none of the other thresholds 404-412 are exceeded, then the process 100 can be configured to continue with a MJC operation. The printer 10 can select the HJS or MJC mode using a plurality of threshold counter distributions in different operating modes. For example, a lower quality print mode can require a larger count for one or more of the thresholds before applying HJS in order to maintain higher printed page throughput using the MJC mode. A higher quality print mode can select the HJS print mode for smaller threshold counter values to maintain higher quality printed output with a lower throughput.

Figure 5B:
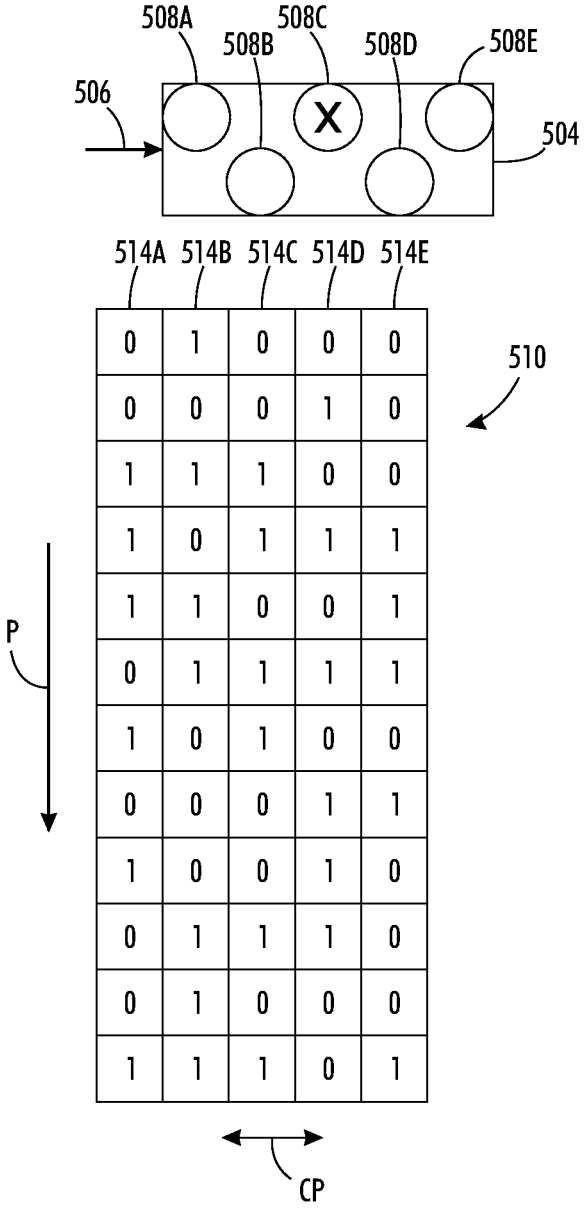
FIG. 5B is a schematic diagram of a printhead in a hard jet substitution mode with binary image data corresponding to an inoperable inkjet and operational inkjet in the printhead.

FIG. 5B depicts the printhead 504 during an HJS operation. During a regular printing operation, the inkjets 508A, 508B, 508D, and 508E print ink drops onto an image receiving surface in locations corresponding to the activated pixels in the columns 514A, 514B, 514C, and 514D, respectively. The inoperable inkjet 508C does not eject ink drops, and no ink drops are printed into the locations corresponding to activated pixels in the column 514C. During HJS, an actuator moves an operational inkjet in the printhead 504 into a cross-process direction location that corresponds to the image data column 514C. In the example of FIG. 5B, the actuator moves the printhead 504 in direction 506 to register the inkjet 508B with the cross-process direction location of the column 514C in the image data 510. The image receiving surface passes the printhead 504 a second time, and the inkjet 508B ejects ink drops onto the image receiving surface in locations corresponding to the activated pixels in the column 514C.

In the printer 10, the image receiving member 12 rotates past printheads in the printhead assemblies 32 and 34 at least one time to receive ink drops from the operational printheads on the image receiving surface 14. During HJS, one or more actuators in the printhead assemblies 32 and 34 move one of the printheads in the assemblies to position operational inkjets in the moved printhead into registration with the location of the image data corresponding to the inoperable inkjet. The one operational inkjet ejects ink drops onto the image receiving surface 14 during a subsequent rotation of the image receiving member 12 to correct for the inoperable inkjet.

Figure 5C:
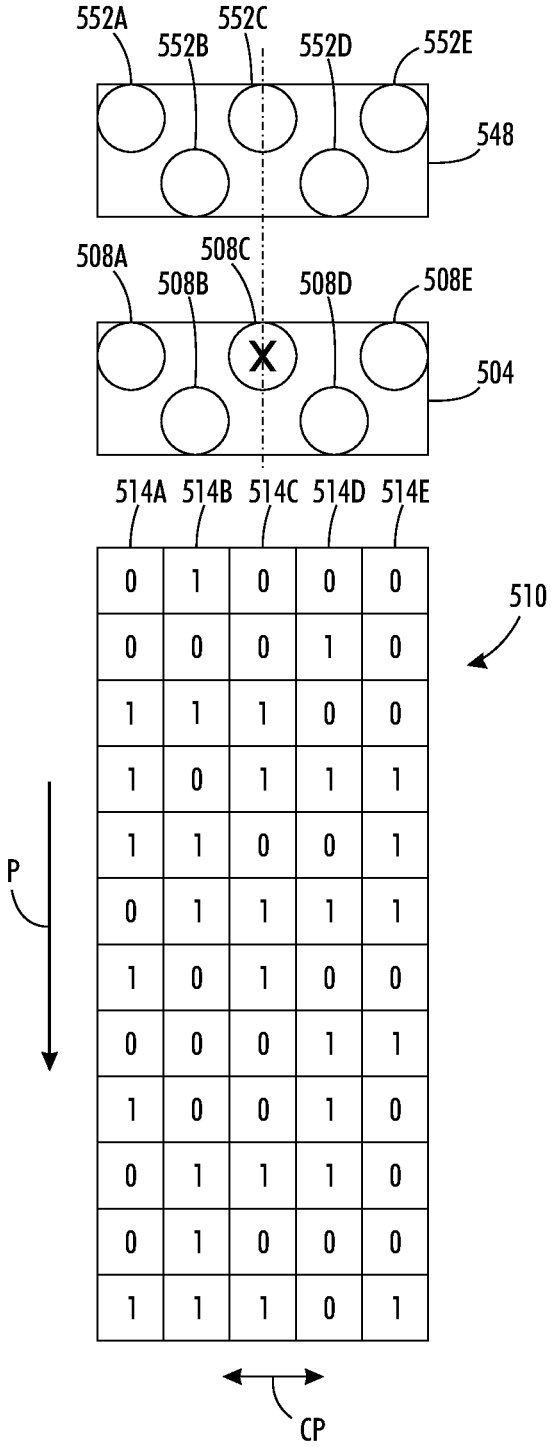
FIG. 5C is a schematic diagram of a printhead in a camouflage mode with binary image data corresponding to an inoperable inkjet and operational inkjet in the printhead.

FIG. 5C depicts another configuration of printheads that can perform HJS. In FIG. 5C, a second printhead 548 includes inkjets 552A, 552B, 552C, 552D, and 552E. The printheads 548 and 504 both eject the same color of ink. The operational inkjet 552C is aligned with the inoperable inkjet 508C in the cross-process direction. During HJS, the inkjet 552C ejects ink drops onto the locations of the image receiving surface corresponding to the activated pixels in image data column 514C.

Figure 5D:
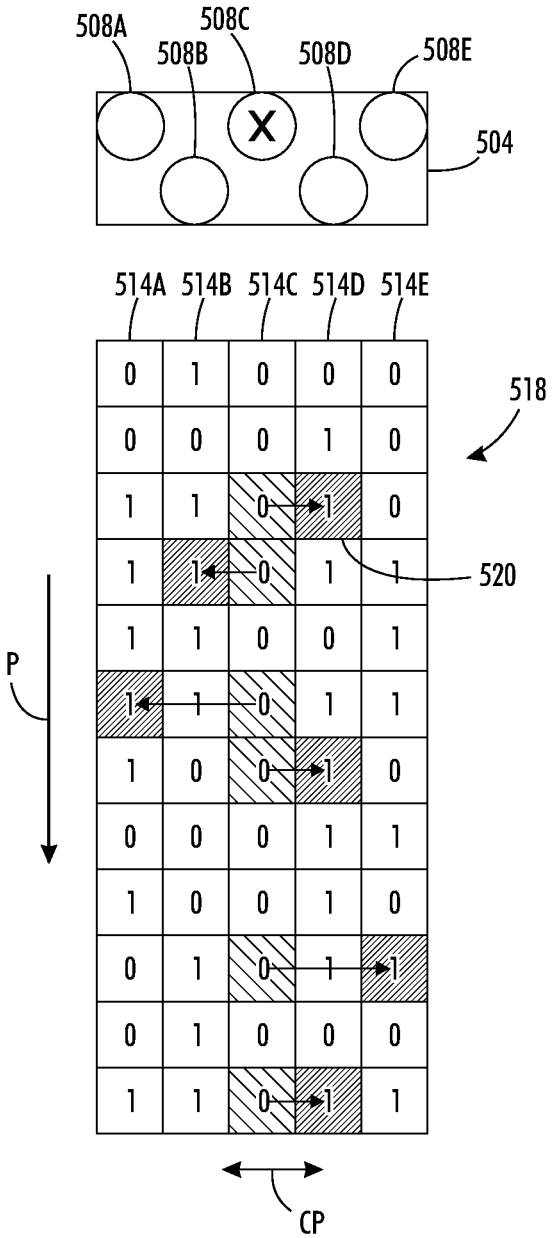
FIG. 5D is a schematic diagram of a printhead with an inoperable inkjet and a second printhead with another inkjet that ejects ink drops to compensate for the inoperable inkjet.

FIG. 5D depicts the printhead 504 and image data 518 that are configured to perform an ink MJC operation. Prior to ejecting ink drops, the controller 80 activates pixels in the image data corresponding to the operational inkjets 508A-508B and 508C-508D that are proximate to the inoperable inkjet 508C in the cross-process direction. FIG. 5D depicts the modified image data 518 with activated pixels, such as pixel 520, that substitute for the activated pixels in the pixel column 514C. In the example of FIG. 5D, the controller 80 also deactivates the pixels in the column 514C. The activated pixels for the neighboring inkjets are pixels that are deactivated in the original image data. The MJC process identifies deactivated neighboring pixels that are proximate to the inoperable inkjet in the cross-process direction, and activates the pixels to compensate for the activated pixels that correspond to the inoperable inkjet 508. During a printing operation, the operational inkjets 508A-508B and 508D-508E eject ink drops into locations of the image receiving surface that correspond to the modified image data 518.

In the printer 10, the image receiving member 12 rotates past the printhead units 32 and 34, and the operational inkjets eject ink drops onto the image receiving surface 14 in locations corresponding to the activated pixels in the image data 518. The MJC process does not require an additional rotation of the image receiving member 12 to eject additional ink drops beyond the number of rotations that are used for standard printing operations.

Figure 5E:
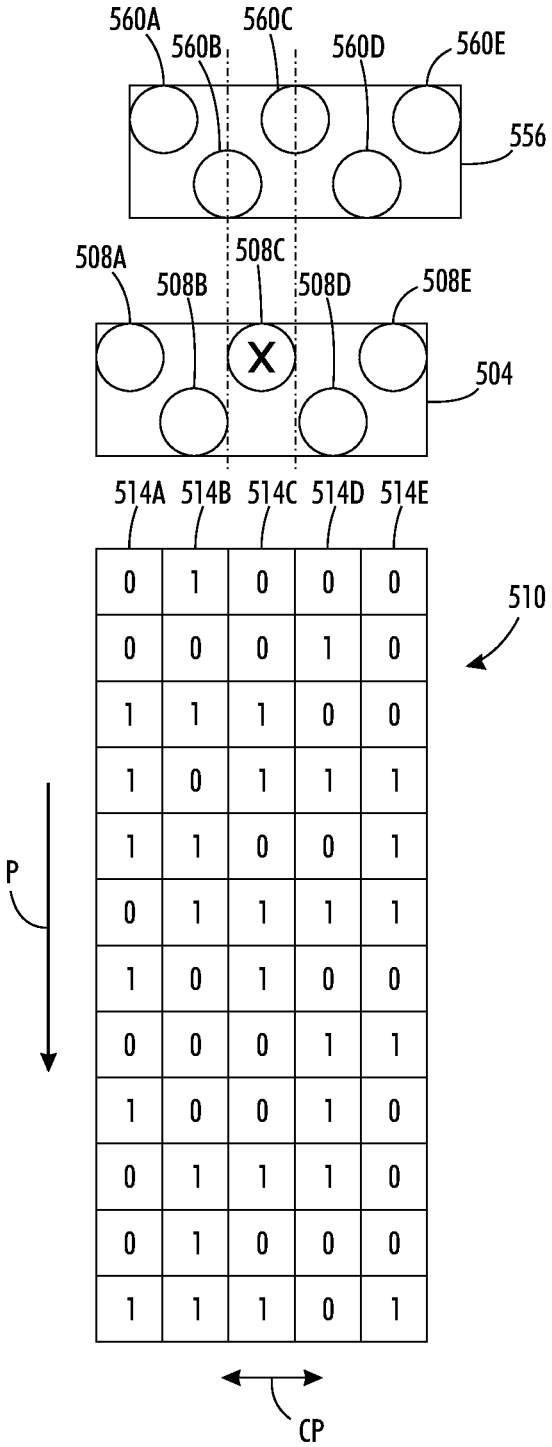
FIG. 5E is a schematic diagram of a first printhead with an inoperable inkjet and a second printhead with inkjets that compensate for the inoperable inkjet in the first printhead.

FIG. 5E depicts another arrangement of printheads in a printer. In FIG. 5E, a second printhead 556 includes inkjets 560A, 560B, 560C, 560D, and 560E. The printhead 556 is offset from the printhead 504 in the cross-process direction by approximately one half of the cross-process direct distance between adjacent inkjets in the printheads 504 and 506. For example, the inkjet 560B in printhead 556 has a cross-process location that is substantially centered between inkjets 508B and 508C in the printhead 504 in the cross-process direction. Additionally, inkjet 560C in the printhead 556 is substantially centered between inkjets 508C and 508D in the cross-process direction. Some printer embodiments employ staggered printheads in the configuration of FIG. 5E in order to effectively double the cross-process direction resolution of ink images that are printed with the staggered printheads. For example, if printheads 504 and 560 are each configured to print with a resolution of 300 dots per inch (DPI), then the combination of printheads 504 and 560 prints with a resolution of 600 DPI. In an alternative MJC process, either one of the inkjets 560B or 560C eject ink drops onto pixel locations that are offset from the activated pixels in the column 514C by one-half of a pixel in the cross-process direction. The one-half pixel offset can reduce image defects that are generated by the inoperable inkjet 508C without requiring a full HJS process.

One printer embodiment that includes an interleaved arrangement of printheads as depicted in FIG. 5E is a continuous web inkjet printer. As is known in the art, continuous web inkjet printers form ink images on elongated print media, such as long rolls of paper. The continuous web printers form a plurality of printed images on the web corresponding to multiple pages in a print job, and a finisher device cut the paper roll into individual printed pages after completion of the print job. In one embodiment of a continuous web printer, the media web moves past inkjets in a plurality of interleaved printheads and the inkjets eject ink drops directly onto a surface of the media web.

During a print job, the web printer employs process 100 to select MJC or HJS for correction of inoperable inkjets during printing of ink images on the media web. In a continuous web printer, each side of the media web typically moves past the printheads only once to receive the printed ink images. The web printer operates either or both of the inkjets in the interleaved printhead, such as inkjets 560B and 560C in FIG. 5E, to perform HJS in a continuous web printer. For some image data, both of the inkjets 560B and 560C may already be activated when the image data include activated pixels for the inoperable inkjet 508C, in which case the web printer can fall back to the MJC operation described above with reference to block 132.

In some printer embodiments, the process 100 is applied to image data for a full printed page that is transferred to one side of a print medium, such as a paper sheet. A printer, such as the printer 10, selects either an HJS or MJC operation for each page, and a single print job can include a combination of HJA and MJC operations on different pages. For example, if a first page includes a high density header region that includes a series of pixels corresponding to the inoperable inkjet, then the image data density exceeds the density thresholds and the printer 10 applies HJS to substitute for the inoperable inkjet with an operational inkjet. If a second page in the print job includes a lower density half-toned area around the inoperable inkjet, then the printer 10 can apply a MJC operation to compensate for the inoperable inkjet. Thus, process 100 enables the printer 10 and other inkjet printers to select an inoperable inkjet compensation operation dynamically with reference to properties of the image data for each page to maintain high quality printed output and high image throughput during operation.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for compensating for an inoperable inkjet in a printer comprising:

identifying a plurality of activated pixels in image data corresponding to the inoperable inkjet in a first printhead in the printer;

identifying an image density of activated pixels in a first region of the image data that includes at least one activated pixel corresponding to the inoperable inkjet, the first region of the image data having a length corresponding to a first predetermined number of pixels in a process direction;

identifying an image density of activated pixels in a second region of the image data that includes the at least one activated pixel corresponding to the inoperable inkjet, the second region of the image data having a length corresponding to a second predetermined number of pixels in the process direction, the second predetermined number of pixels being greater than the first predetermined number of pixels;

operating one other inkjet to eject ink drops onto an image receiving surface at a plurality of locations corresponding to the plurality of activated pixels for the inoperable inkjet in response to the identified image density for the first region exceeding a first predetermined density threshold;

modifying the image data to include an additional plurality of activated pixels proximate to the plurality of activated pixels corresponding to the inoperable inkjet in response to the identified image density for the second region exceeding a second predetermined density threshold and the identified image density for the first region not exceeding the first predetermined density threshold, the additional plurality of activated pixels corresponding to a plurality of inkjets that are proximate to the inoperable inkjet in the cross-process direction; and operating the plurality of inkjets proximate to the inoperable inkjet to eject ink drops with reference to the additional plurality of activated pixels in the image data in response to the identified image density for the second region exceeding the second predetermined density threshold and the identified image density for the first region not exceeding the first predetermined density threshold.

2. The method of claim 1, the operation of the plurality of inkjets proximate to the inoperable inkjet further comprising:

operating at least one inkjet in a second printhead that is different than the first printhead, the at least one inkjet having an offset in a cross-process direction from the inoperable inkjet that is less than a cross-process direction offset between the inoperable inkjet and a nearest operational inkjet in the first printhead.

3. The method of claim 1, further comprising:

identifying an image density for each region in a plurality of other regions in the image data, each region in the plurality of other regions having a length in the process direction equal to the length of the first region in the process direction and each region in the plurality of other regions having at least one activated pixel corresponding to the inoperable inkjet; and operating the one other inkjet to eject ink drops at the plurality of locations on the image receiving surface corresponding to the plurality of activated pixels for the inoperable inkjet in response to a predetermined number of the identified image densities for the first region and for the plurality of other regions exceeding the first predetermined image density threshold.

4. The method of claim 1, the operation of the one other inkjet further comprising:

moving the first printhead from a first location to a second location in the cross-process direction to place the one other inkjet in a cross-process direction location that corresponds to a cross-process direction location of the inoperable inkjet when the first printhead is in the first location; and moving the image receiving surface past the first printhead to enable the one other inkjet to eject ink drops for the plurality of activated pixels in the image data corresponding to the inoperable inkjet.

5. An inkjet printer comprising:

a first printhead including a plurality of inkjets;

an image receiving surface configured to move past the first printhead in a process direction to receive ink ejected from the plurality of inkjets;

a memory configured to store image data; and a controller operatively connected to the memory and the first printhead and configured to:

identify a plurality of activated pixels in the image data corresponding to an inoperable inkjet;

identify an image density of activated pixels in a first region of the image data that includes at least one activated pixel corresponding to the inoperable inkjet, the first region of the image data having a length corresponding to a first predetermined number of pixels in a process direction;

identify an image density of activated pixels in a second region of the image data that includes the at least one activated pixel corresponding to the inoperable inkjet, the second region of the image data having a length corresponding to a second predetermined number of pixels in the process direction, the second predetermined number of pixels being greater than the first predetermined number of pixels;

operate one other inkjet to eject ink drops onto the image receiving surface at a plurality of locations corresponding to the plurality of activated pixels for the inoperable inkjet in response to the identified image density for the first region exceeding a first predetermined density threshold;

modify the image data to include an additional plurality of activated pixels proximate to the plurality of activated pixels corresponding to the inoperable inkjet in response to the identified image density for the second region exceeding a second predetermined density threshold and the identified image density for the first region not exceeding the first predetermined density threshold, the additional plurality of activated pixels corresponding to a plurality of inkjets that are proximate to the inoperable inkjet in the cross-process direction; and operate the plurality of inkjets that are proximate to the inoperable inkjet to eject ink drops with reference to the additional plurality of activated pixels in the image data in response to the identified image density for the second region exceeding the second predetermined density threshold and the identified image density for the first region not exceeding the first predetermined density threshold.

6. The printer of claim 5, further comprising:

an actuator configured to move the first printhead in a cross-process direction; and the controller being operatively connected to the actuator and further configured to:

identify the one other inkjet as one of the plurality of inkjets in the first printhead other than the inoperable inkjet;

move the first printhead from a first location to a second location in the cross-process direction with the actuator to place the one other inkjet at a cross-process location that corresponds to a position of the inoperable inkjet when the first printhead was at the first location;

move the image receiving member past the first printhead; and operate the one other inkjet to eject ink drops in the plurality of locations on the image receiving surface corresponding to the plurality of activated pixels for the inoperable inkjet.

7. The printer of claim 5, further comprising:

a second printhead including the one other inkjet aligned with the inoperable inkjet in a cross-process direction; and the controller being further configured to:

operate the one other inkjet in the second printhead to eject ink drops in the plurality of locations on the image receiving surface corresponding to the plurality of activated pixels for the inoperable inkjet.

8. The printer of claim 5, the controller being further configured to operate the plurality of inkjets that are proximate the inoperable inkjet by:

operating an inkjet in a second printhead that is different than the first printhead, the inkjet in the second printhead having an offset in a cross-process direction from the inoperable inkjet in the first printhead that is less than a cross-process direction offset between the inoperable inkjet and a nearest operational inkjet in the first printhead.

* * * * *